United States Patent [19]

Coupland et al.

[11] 4,261,742

[45] Apr. 14, 1981

[54] PLATINUM GROUP METAL-CONTAINING ALLOYS

[75] Inventors: Duncan R. Coupland, Maidenhead; Allin S. Pratt, Wallingford, both of England

[73] Assignee: Johnson, Matthey & Co., Limited, London, England

[21] Appl. No.: 76,729

[22] Filed: Sep. 18, 1979

[30] Foreign Application Priority Data

Sep. 25, 1978 [GB] United Kingdom ..... 37978/78

[51] Int. Cl.[3] ..... C22C 19/05

[52] U.S. Cl. ..... 75/134 F; 75/171; 148/32.5

[58] Field of Search ..... 75/171, 170, 134 F; 148/32, 32.5

[56] References Cited

U.S. PATENT DOCUMENTS 4,018,569 4/1977 Chang ..... 75/171

*Primary Examiner*—R. Dean

*Attorney, Agent, or Firm*—Cushman, Darby & Cushman

[57] ABSTRACT

This invention relates to platinum group metal-containing alloys and to uses of such alloys. In particular, the invention relates to platinum group metal-containing superalloys and to their uses. In particular, superalloys according to the present invention consist apart from impurities, of:

(a) 5 to 25 wt % chromium,
(b) 2 to 7 wt % aluminium,
(c) 0.5 to 5 wt % titanium,
(d) at least one of the metals yttrium and scandium present in a total amount of 0101 to 3 wt %,
(e) 3 to 15 wt % in total of one or more of the platinum group metals platinum, palladium, rhodium, iridium, osmium and ruthenium and
(f) balance nickel.

6 Claims, 4 Drawing Figures

PLATINUM GROUP METAL-CONTAINING ALLOYS

Figure 1:
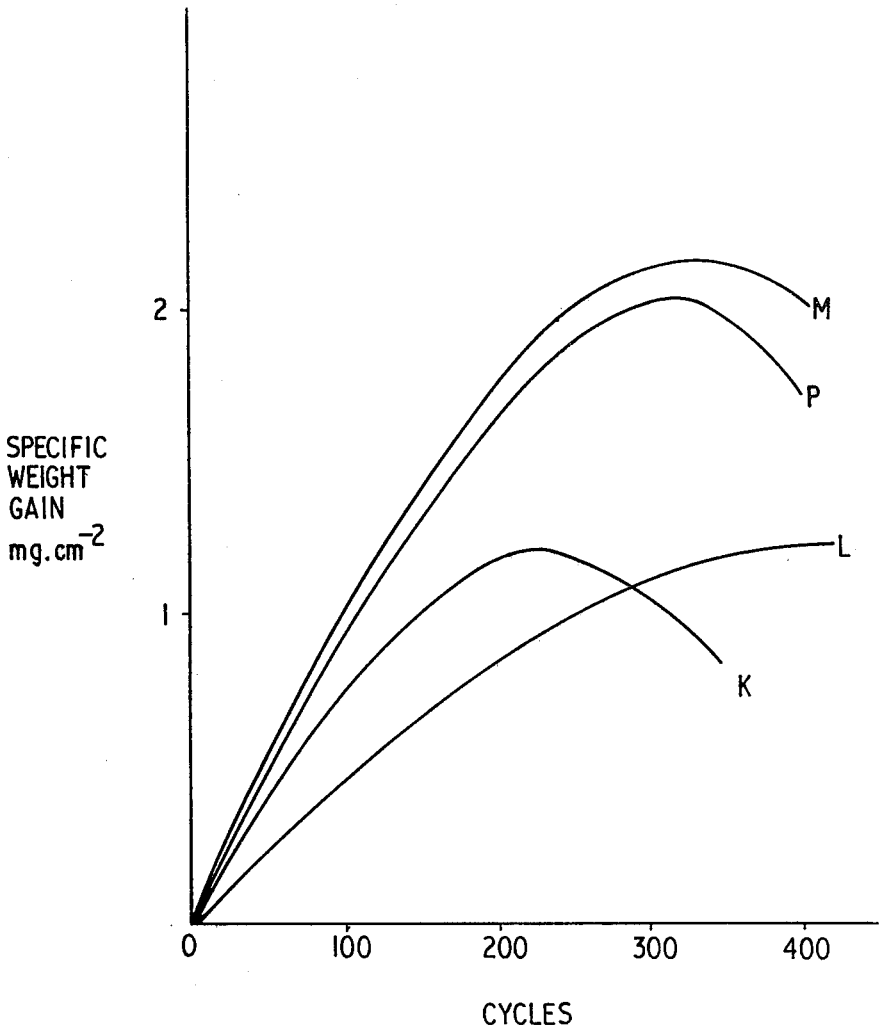

This invention relates to platinum group metal-containing alloys and to uses of such alloys. In particular, the invention relates to platinum group metal-containing superalloys and to their uses.

The term "superalloy" is applied in the art to complex nickel-and/or cobalt-based alloys with additions of such metals as chromium, tungsten, molybdenum, titanium, aluminium and iron and which exhibit high values of mechanical strength and creep resistance at elevated temperatures and improved oxidation and hot corrosion resistance. In the case of nickel based superalloys, high hot strength is obtained partly by solid solution hardening using such elements as tungsten or molybdenum and partly by precipitation hardening. The precipitates are produced by adding aluminium and titanium to form the intermetallic compound $\gamma'$, based on $Ni_3(Ti,Al)$, within the host material. In the case of cobalt based superalloys, stable metal carbides are intentionally formed in some instances for secondary strengthening purposes, solid solution strengthening providing the main source of strength.

The properties of superalloys in general render them eminently suitable for use in corrosive and/or oxidising environments where high strength is required at elevated temperatures. For example, in the glass industry and particularly in the manufacture of glass fibre, for example for roof insulation material, good hot strength is required combined with creep resistance and very high corrosion resistance, the latter because certain elements present in glass, notably boron and sodium, are extremely corrosive at the temperature of molten glass.

Further, superalloys are suitable for use as materials for fabricating components, such as blades, vanes and so on, for use in gas turbine engines. Such engines for marine use, for example, typically operate on low-grade fuel having a relatively high sulphur concentration; good hot corrosion resistance is therefore required under these circumstances also.

Gas turbines for use in jet aircraft, on the other hand, typically operate on high-grade fuel which requires that the engine component parts are made from material having good high temperature oxidation resistance. Yet a further use of super-alloys is in the fuel industry, particularly in coal gasification plants which are of increasing potential importance due to the abundance of coat relative to other fossil fuels in the earth's crust.

There are many variations for coat gasification systems but most of them are based on one of two classical methods which basically seek to add hydrogen to coal to produce pipeline gas containing in excess of 90% methane. In the first method, coal is reacted with steam to form synthesis gas, hydrogen and carbon monoxide which are then catalytically recombined to form methane. The coal/steam reaction is highly endothermic and requires very high temperatures to proceed at practical rates; the apparatus used is also subject to erosion due to the particulate matter entrained in the reaction gas stream. In the second method, coal is subject to destructive hydrogenation to form methane directly. In one example of this method, pulverized and pretreated bituminous coal is reacted at up to about 1000° C. at high pressure with hot, raw hydrogen-rich gas containing a substantial amount of steam. The pretreatment step consists of mild surface oxidation to prevent agglomeration during the hydrogasification step.

For these and other applications, superalloys have proved to be indispensable. However, as technology advances, ever more rigorous conditions are encountered and the demands made upon materials are in consequence ever more exacting. It has been found that there is a limit to the uses of superalloys, as the term is currently understood, in that at elevated temperatures, say of the order of 1,000° C., their tensile creep strength tends to diminish due to the $\gamma^1$ phase redissolving in the $\gamma$ phase. A solution to this problem is proposed in the specification of our British Pat. No. 1,520,630, in which there are described and claimed superalloys having additions of one or more platinum group metals. The addition of the platinum group metal has the effect of increasing the high temperature strength and creep resistance of the alloy by solid solution hardening and by raising the temperature of dissolution of the $\gamma'$ as well as considerably improving the oxidation and hot corrosion resistance thereof which are functions of surface oxide stability and the ability of the alloy to withstand grain boundary penetration.

We have found, however, that the teaching of said British patent specification No. 1,520,630, is only a partial solution in that, although surface oxide stability is provided, the ability of the alloy to restrict grain boundary penetration is not in all cases satisfactory. Dispersion-strengthened nickel-base alloys have also been proposed in order to improve high-temperature creep strength but, since such alloys do not contain a $\gamma'$ strengthening phase, their low-temperature tensile creep strength is impaired and, in any case, there is only limited benefit in oxidation or hot corrosion resistance. Dispersion-strengthened superalloys—that is, containing a precipitated $\gamma'$ phase as well as an oxide dispersion—have also been proposed but their benefits have been mainly in increasing the mechanical strength.

It is therefore an object of this invention to increase still further the oxidation and hot corrosion-resistance of superalloys, particularly by increasing the ability of the alloy to withstand grain boundary penetration.

Further objects of the invention are to provide methods for handling molten glass, for example in the manufacture of glass fibre, for operating a gas turbine and for gasification of coal using structural components fabricated from a superalloy having improved oxidation- and hot-corrosion-resistance.

We have surprisingly found that the objects of the invention may be realised by adding either yttrium and/or scandium to a platinum group metal-containing superalloy, particularly of the type described in our British Pat. No. 1,520,630.

According to a first aspect of the invention, therefore, a superalloy for structural use at elevated temperatures and in highly corrosive and/or axidising environments consists of, apart from impurities:

(a) 5 to 25 wt % chromium,
(b) 2 to 7 wt % aluminium,
(c) 0.5 to 5 wt % titanium,
(d) at least one of the metals yttrium and scandium present in a total amount of 0.01 to 3 wt %,
(e) 3 to 15 wt % in total of one or more of the platinum group metals platinum, palladium, rhodium, iridium, osmium and ruthenium and
(f) balance nickel According to further aspects of the invention, a method of handling molten glass, for example in the manufacture of glass fibre, a method of burning a fuel: air mixture in a gas turbine engine and a method of producing pipeline gas from coal are characterised in that they use apparatus constructed from a superalloy consisting of, apart from impurities:

(a) 5 to 25 wt % chromium
(b) 2 to 7 wt % aluminium,
(c) 0.5 to 5 wt % titanium,
(d) at least one of the metals yttrium and scandium present in a total amount of 0.01 to 3 wt %,
(e) 3 to 15 wt % of one or more of the platinum group metals platinum, palladium, rhodium, iridium, osmium and ruthenium and
(f) balance nickel.

Superalloys according to the invention may be modified by the addition of one or more of the constituents listed in the following Table in an amount from a trace to the figure, in wt %, stated.

| | | | |
|---|---|---|---|
| Cobalt | 20 | Niobium | 3 |
| Tungsten | 15 | Boron | 0.15 |
| Molybdenum | 12 | Carbon | 0.5 |
| Hafnium | 2 | Tantalium | 10 |
| Manganese | 2 | Zirconium | 1.5 |
| Magnesium | 2 | Iron | 15 |
| Silicon | 2 | Rhenium | 4 |
| Vanadium | 2 | Thorium/rare earth metals or oxides therefor | 3 |

The yttrium and/or scandium components of alloys according to the invention may be present at least in part as their oxides.

Superalloys according to the invention may be divided looseley into two groups, known respectively as "alumina-formers" and "chromia-formers". Alloys in the former group contain an amount of aluminium towards the upper end of the range quoted and tend, on oxidation, to form an alumina-rich scale and alloys in the latter group likewise contain an amount of chromium towards the upper end of the range quoted and tend, on oxidation, to form a chromia-rich scale. As indicated above, however, the distinction between the two groups is not clear-cut.

The following table gives some examples of so-called "alumina-formers" according to the invention, together with a preferred range of constituents. All figures are in wt % and represent nominal composition, and nickel (not quoted in the table) constitutes the balance.

| | ALLOY | | | | | |
|---|---|---|---|---|---|---|
| | A | B | C | D | E | RANGE |
| Cr | 8.5 | 8.3 | 8.0 | 6.0 | 9.0 | 5-11 |
| Al | 5.0 | 4.0 | 6.0 | 6.0 | 5.5 | 3.5-6 |
| Ti | 2.0 | 2.0 | 1.0 | 1.0 | 4.75 | 1-5 |
| Y | 0.4 | 0.4 | | 1.0 | 0.5 | 0.01-3 |
| Sc | | 0.5 | 1.5 | | | 0.01-3 |
| Pt | 10.0 | 4.0 | 8.0 | 10.0 | 12.5 | 3-15 |
| Co | 9.5 | 9.4 | 8.5 | 10.0 | 14.0 | 8-15 |
| W | 3.0 | 5.0 | 3.0 | 0.1 | | 0-6 |
| Ta | 1.0 | 1.0 | 4.0 | | | 0-5 |
| Nb | 0.5 | 2.0 | 2.0 | 0.1 | | 0-3 |
| Mo | 0.01 | | 6.0 | 7.5 | 3.0 | 0-8 |
| C | 0.15 | 0.15 | 0.25 | 0.1 | 0.15 | 0-0.5 |
| B | 0.015 | 0.015 | 0.025 | 0.025 | 0.015 | 0-0.15 |
| Zr | 0.05 | 0.05 | 0.05 | 0.10 | 0.05 | 0-1.0 |
| Hf | 0.01 | | 1.5 | 0.05 | | 0-2.0 |
| Si | 1.0 | | | 0.7 | | 0-2.0 |
| Mn | 1.5 | | | | | 0-2.0 |
| Mg | | | 0.05 | | | 0-2.0 |
| Fe | 0.05 | 0.05 | 0.05 | 1.05 | 0.05 | 0-1.5 |
| Re | | | | | 2.0 | 0-4 |
| Th/rare earths | | | | | 2.0 | 0-3 |

The following table gives some examples (alloys F-M) of so-called "chromia-formers" according to the invention, together with a preferred range of constituents. Again, all figures are in wt % and represent nominal composition, and nickel constitutes the balance. Alloys N-P are alloys without platinum and yttrium and/or scandium and are included by way of comparison.

| | ALLOY | | | | | | | | | | | |
|---|---|---|---|---|---|---|---|---|---|---|---|---|
| | F | G | H | I | J | K | L | M | N | O | P | RANGE |
| Cr | 11.5 | 21.5 | 14.5 | 16.0 | 12.1 | 12.1 | 12.1 | 12.1 | 12.1 | 12.1 | 12.5 | 10-25 |
| Al | 3.0 | 1.4 | 4.25 | 3.0 | 3.4 | 3.4 | 3.4 | 3.4 | 3.4 | 3.5 | 3.5 | 1-4.5 |
| Ti | 4.25 | 3.7 | 1.75 | 3.5 | 3.6 | 3.6 | 3.6 | 3.6 | 3.6 | 4.1 | 4.1 | 1.5-5.0 |
| Y | 0.2 | | 0.5 | 0.7 | 0.05 | 0.1 | 0.2 | | | | 0.1 | 0.01-3 |
| Sc | | 1.0 | | | | | | 0.1 | | | | 0.01-3 |
| Pt | 7.5 | 10.0 | 12.5 | 6.0 | 4.6 | 4.6 | 4.6 | 4.6 | 4.6 | | | 3-15 |
| Co | 7.5 | 18.0 | 9.0 | 8.0 | 9.3 | 9.3 | 9.3 | 9.3 | 9.3 | 9.0 | 9.0 | 0-20 |
| W | 3.6 | 2.0 | | 12.5 | 3.0 | 3.0 | 3.0 | 3.0 | 3.0 | 4.0 | 4.0 | 0-15 |
| Ta | 3.6 | 1.4 | | | 3.5 | 3.5 | 3.5 | 3.5 | 3.5 | 3.9 | 3.9 | 0-5 |
| Nb | 0.4 | 1.0 | 1.75 | 1.0 | | | | | | | | 0-2 |
| Mo | 1.8 | | 1.75 | | 1.7 | 1.7 | 1.7 | 1.7 | 1.7 | 2.0 | 2.0 | 0-6 |
| C | 0.10 | 0.15 | 0.25 | 0.05 | 0.1 | 0.1 | 0.1 | 0.1 | 0.1 | 0.13 | 0.13 | 0-0.5 |
| B | 0.02 | 0.01 | 0.015 | 0.02 | 0.014 | 0.014 | 0.014 | 0.014 | 0.014 | 0.015 | 0.015 | 0-0.1 |
| Zr | 0.1 | 0.15 | 0.05 | 0.05 | 0.04 | 0.04 | 0.04 | 0.04 | 0.04 | 0.11 | 0.11 | 0-1.0 |
| Hf | 0.8 | | 1.0 | | 0.75 | 0.75 | 0.75 | 0.75 | 0.75 | 0.88 | 0.88 | 0-1.5 |
| Si | | 1.0 | | | | | | | | | | 0-2.0 |
| Mn | 1.5 | | | 0.01 | | | | | | | | 0-2.0 |
| Mg | | | 0.5 | | | | | | | | | 0-2.0 |
| Fe | 0.05 | 1.0 | 0.05 | 7.5 | | | | | | | | 0-15 |
| Re | | 2.5 | | | | | | | | | | 0-4.0 |
| Th/rare earths | | | 2.0 | | | | | | | | | 0-3.0 |

Alloys according to the invention may be prepared by standard techniques such as vacuum melting and casting of the metallic components.

We have found that platinum group metal, when added to superalloys, tends to partition preferably to the $\gamma'$ in the proportion of at least 2:1. Its presence in the $\gamma'$ phase raises the temperature of dissolution of the said phase in the $\gamma$ host material thus contributing directly to improved mechanical properties to rather higher temperatures than have been achieved hitherto with conventional superalloys. We believe that the presence of yttrium and/or scandium in alloys according to the present invention influences the partition of the platinum group metal and forms a further phase consisting predominantly of yttrium/scandium, nickel and platinum group metal, thus lowering the concentration of platinum group metal throughout the remainder of the alloy. The lower concentration is nevertheless sufficient to impart the normal benefits to the remainder of the alloy, while the yttrium/scandium and platinum group metal phase tends to provide added protection against oxidation and hot corrosion conditions by virtue of being present along the grain boundaries.

The following test results have been obtained for selected alloys according to the invention.

(i) Cyclic oxidation (Table 1 and FIG. 1)

Each cycle consisted of placing a sample of the test alloy in a furnace at a temperature of 980° C. for 40 minutes and thereafter removing the sample into room temperature for 20 minutes. A good result would be expected to show a slight weight gain due to surface oxidation; a significant weight gain is due to internal oxidation and weight loss is due to spallation, both of which are unacceptable. The results show that oxidation resistance is improved for alloys containing yttrium and platinum and slightly impaired for the alloy (M) containing scandium and platinum compared with the alloy (P) containing yttrium but no platinum. Alloy L (0.2% Y) shows particularly good results.

TABLE 1

| ALLOY | NO. OF CYCLES | SPECIFIC WEIGHT CHANGE mg cm$^{-2}$ |
|---|---|---|
| K | 0 | 0 |
| | 186 | +1.13 |
| | 218 | +1.24 |
| | 332 | +0.92 |
| L | 0 | 0 |
| | 186 | +1.31 |
| | 218 | +0.84 |
| | 332 | +1.21 |
| | 385 | +1.20 |
| M | 0 | 0 |
| | 186 | +1.77 |
| | 218 | +1.80 |
| | 332 | +2.47 |
| | 385 | +1.80 |
| P | 0 | 0 |
| | 186 | +1.70 |
| | 218 | +1.80 |
| | 332 | +2.05 |
| | 385 | +1.70 |

Figure 2:
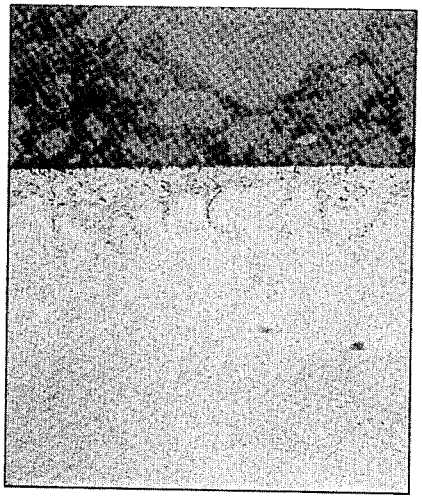
Figure 3:
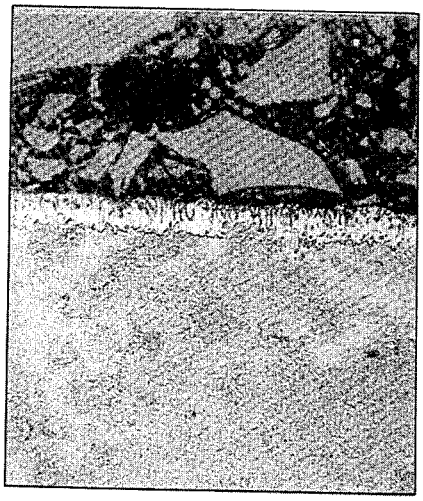
Figure 4:
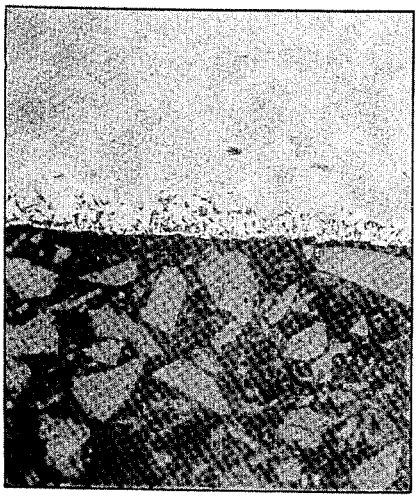

(ii) Crucible sulphidation (i.e., hot corrosion) (Table 2 and FIGS. 2-4)

This test was carried out by immersing samples for 90 hours in a mixture of sodium sulphate and sodium chloride in a ratio by weight of 90:10 at a temperature of 825° C.

TABLE 2

| ALLOY | SPECIFIC WEIGHT CHANGE mg cm$^{-2}$ |
|---|---|
| J | −0.45 |
| K | −0.54 |
| L | +0.44 |
| M | −0.82 |
| P | +71.32 |
| N | −0.47 |

TABLE 2-continued

| ALLOY | SPECIFIC WEIGHT CHANGE mg cm$^{-2}$ |
|---|---|
| O | +101.1 |

The results demonstrate that the addition of yttrium (alloy P) to an alloy containing no platinum (alloy O) results in a moderate increase in sulphidation (i.e., hot corrosion) resistance and that additions of platinum and yttrium (alloys J, K and L) and platinum and scandium (alloy M) result in outstanding increases in sulphidation resistance. The benefit of platinum and yttrium additions over platinum alone (alloy n) is not apparent from these results, but is nevertheless shown clearly by FIGS. 2-4 which are photomicrographs (x 500) of cross-sections of alloys L, M and N after the immersion sulphidation test. In FIG. 2 (alloy N), the surface corrosion scale is seen to be invading the mass of the alloy in a direction generally normal to the surface, thereby providing sites gor grain boundary penetration leading to ultimate catastrophic failure. FIG. 3 (alloy L; Pt+Y additions) demonstrates the beneficial result of adding yttrium to a platinum-containing alloy in that the scale forms a non-invasive discrete layer which shows no evidence of grain boundary penetration and as such is protecting the mass of the alloy from further attack. FIG. 4 (alloy M; Pt+Sc additions) is similar to FIG. 3 but the boundary between scale and massive alloy is not quite so even; conceivably grain boundary attack would eventually ensue.

(iii) Resistance to corrosive atmospheric oxidation/corrosive liquid

This test was carried out by suspending a flat sample of test alloy (alloy A) on one side to an atmosphere of air and boric oxide and on the other side to air at a temperature of 1050° C. for 50 hours. The resulting weight change due to the formation of an external oxide film was +0.031% and the film was very thin and adherent with no evidence of pitting. The corresponding alloy without yttrium (not listed in the specification) suffered, in a similar test at 1100° C. over 24 hours, a weight loss of 0.04–0.05% and the oxide film was less adherent and sustained minor damage. In a further test, a crucible made from alloy A was filled with molten glass and hed at 1100° C. for 100 hours. There was no evidence of attack, eitheron the inside or the outside of the crucible.

We claim:

1. A superalloy consisting essentially, apart from impurities, of:
   (a) 5 to 25 wt % chromium,
   (b) 2 to 7 wt % aluminium,
   (c) 0.5 to 5 wt % titanium,
   (d) at least one of the metals yttrium and scandium present in a total amount of 0.01 to 3 wt %,
   (e) 3 to 15 wt % in total of one or more of the platinum group metals platinum, palladium, rhodium, iridium, osmium and ruthenium and
   (f) balance nickel.

2. A superalloy according to claim 1 including one or more of the constituents listed below and present in an amount from a trace to the figure stated in wt %:

| | | | |
|---|---|---|---|
| Cobalt | 20 | Niobium | 3 |
| Tungsten | 15 | Boron | 0.15 |

-continued

| | | | |
|---|---|---|---|
| Molybdenum | 12 | Carbon | 0.5 |
| Hafnium | 2 | Tantalium | 10 |
| Manganese | 2 | Zirconium | 1.5 |
| Magnesium | 2 | Iron | 15 |
| Silicon | 2 | Rhenium | 4 |
| Vanadium | 2 | Thorium/rare earth metals or oxides therefor | 3 |

3. A superalloy according to claim 1 consisting, apart from impurities of:

(a) 5 to 25 wt % chromium,
(b) 3.5 to 6 wt % aluminium,
(c) 1 to 5 wt % titanium,
(d) at least one of the metals yttrium and scandium in a total amount of 0.01 to 3 wt %,
(e) 3 to 15 wt % platinum,
(f) 8 to 15 wt % cobalt, and
(g) balance nickel.

4. A super alloy according to claim 3 including one or more of the constituents listed below and present in an amount from a trace to the figure stated in wt %:

| | | | |
|---|---|---|---|
| tungsten | 6 | hafnium | 2.0 |
| tantalium | 5 | silicon | 2.0 |
| niobium | 3 | manganese | 2.0 |
| molybdenum | 8 | magnesium | 2.0 |
| carbon | 0.5 | iron | 1.5 |

-continued

| | | | |
|---|---|---|---|
| boron | 0.15 | rhenium | 4.0 |
| zirconium | 1.0 | thorium/rare earth metals or oxides thereof | 3.0 |

5. A superalloy according to claim 1 or claim 2 consisting, apart from impurities, of:

(a) 10 to 25 wt % chromium,
(b) 1 to 4.5 wt % aluminium,
(c) 1.5 to 5.0 wt % titanium,
(d) at least one of the metals yttrium and scandium in an amount of 0.01 to 3 wt %,
(e) 3 to 15 wt % platinum, and
(f) balance nickel.

6. A superalloy according to claim 5 including one or more of the constituents listed below and present in an amount from a trace to the figure stated in wt %:

| | | | |
|---|---|---|---|
| cobalt | 20 | zirconium | 1.0 |
| tungstan | 15 | hafnium | 1.5 |
| tantalium | 5 | silicon | 2.0 |
| niobium | 2 | manganese | 2.0 |
| molybdenum | 6 | magnesium | 2.0 |
| carbon | 0.5 | iron | 1.5 |
| boron | 0.1 | rhenium | 4.0 |
| | | thorium/rare earth metals or oxides thereof | 3.0 |

* * * * *